US009224317B2

(12) United States Patent
Lott

(10) Patent No.: US 9,224,317 B2
(45) Date of Patent: Dec. 29, 2015

(54) SIGNALLING APPARATUS AND SENSOR APPARATUS

(75) Inventor: Joerg Lott, Chieming (DE)

(73) Assignee: OSRAM GmbH, Munich (DE)

( * ) Notice: Subject to any disclaimer, the term of this patent is extended or adjusted under 35 U.S.C. 154(b) by 61 days.

(21) Appl. No.: 14/123,114

(22) PCT Filed: May 9, 2012

(86) PCT No.: PCT/EP2012/058543
§ 371 (c)(1),
(2), (4) Date: Nov. 29, 2013

(87) PCT Pub. No.: WO2012/163641
PCT Pub. Date: Dec. 6, 2012

(65) Prior Publication Data

US 2014/0085097 A1 Mar. 27, 2014

(30) Foreign Application Priority Data

May 30, 2011 (DE) ..... 10 2011 076 672

(51) Int. Cl.
*G08B 5/22* (2006.01)
*G09F 9/33* (2006.01)
*H05B 33/08* (2006.01)

(52) U.S. Cl.
CPC ..... *G09F 9/33* (2013.01); *H05B 33/083* (2013.01); *H05B 33/0809* (2013.01); *H05B 33/0827* (2013.01)

(58) Field of Classification Search
CPC ..... G09F 9/33
USPC ..... 340/815.45
See application file for complete search history.

(56) References Cited

U.S. PATENT DOCUMENTS 5,491,349 A 2/1996 Komoto et al.
2006/0232219 A1* 10/2006 Xu ..... 315/209 R
(Continued)

FOREIGN PATENT DOCUMENTS

CN 1784931 A 6/2006
CN 101340760 A 1/2009
(Continued)

OTHER PUBLICATIONS

English abstract of DE 10103611 A1 of Aug. 1, 2002.
(Continued)

*Primary Examiner* — Kerri McNally
(74) *Attorney, Agent, or Firm* — Viering, Jentschura & Partner; Karl Kolbinger

(57) ABSTRACT

A signaling device may include a first signaling illuminant; a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state.

15 Claims, 3 Drawing Sheets

(56) References Cited

U.S. PATENT DOCUMENTS

| | | | | |
|---|---|---|---|---|
| 2007/0257860 | A1* | 11/2007 | Langer | 345/46 |
| 2009/0015759 | A1 | 1/2009 | Honbo | |
| 2011/0057962 | A1 | 3/2011 | Wöhrle et al. | |

FOREIGN PATENT DOCUMENTS

| | | | |
|---|---|---|---|
| CN | 102013216 | A | 4/2011 |
| DE | 3030058 | A1 | 3/1982 |
| DE | 19954911 | A1 | 5/2001 |
| DE | 10103611 | A1 | 8/2002 |
| FR | 2821520 | A1 | 8/2002 |
| WO | 2004100612 | A1 | 11/2004 |
| WO | 2010013177 | A1 | 2/2010 |
| WO | 2010116283 | A2 | 10/2010 |

OTHER PUBLICATIONS

English abstract of DE 19954911 A1 of May 17, 2001.
International Search Report mailed Oct. 15, 2012.
Chinese Office Action based on application No. 2012800208009 (6 pages; 7 pages English translation) dated May 28, 2015.

* cited by examiner

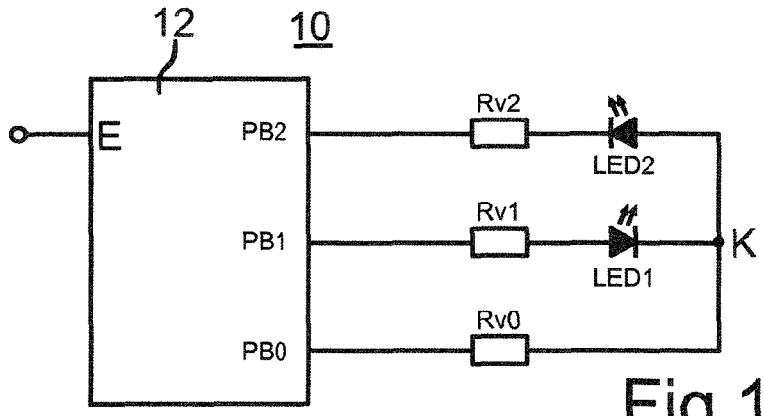
Fig.1
| No | PB0 | PB1 | PB2 | LED1 | LED2 | Status |
|---|---|---|---|---|---|---|
| 1 | Low | Low | Low | 0 | 0 | ok |
| 3 | Open | Low | Low | 0 | 0 | ok |
| 6 | Open | High | Low | 1 | 1 | ok |
| 7 | Low | Open | Low | 0 | 0 | ok |
| 8 | High | Open | Low | 0 | 1 | ok |
| 9 | Open | Open | Low | 0 | 0 | ok |
| 14 | High | High | High | 0 | 0 | ok |
| 15 | Open | High | High | 0 | 0 | ok |
| 17 | High | Open | High | 0 | 0 | ok |
| 18 | Open | Open | High | 0 | 0 | ok |
| 19 | Low | Low | Open | 0 | 0 | ok |
| 21 | Open | Low | Open | 0 | 0 | ok |
| 22 | Low | High | Open | 1 | 0 | ok |
| 23 | High | High | Open | 0 | 0 | ok |
| 24 | Open | High | Open | 0 | 0 | ok |
| 25 | Low | Open | Open | 0 | 0 | ok |
| 26 | High | Open | Open | 0 | 0 | ok |
| 27 | Open | Open | Open | 0 | 0 | ok |
Fig.2
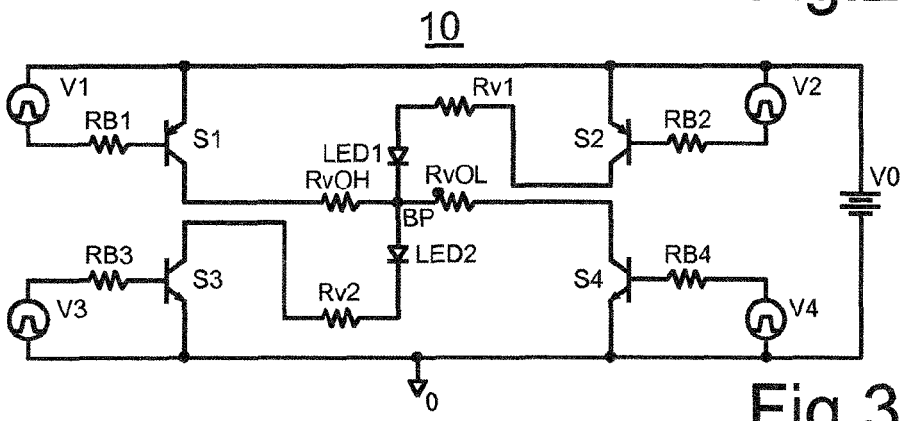
Fig.3

SIGNALLING APPARATUS AND SENSOR APPARATUS

RELATED APPLICATIONS

This application is a national stage entry according to 35 U.S.C. §371 of PCT application No.: PCT/EP2012/058543 filed on May 9, 2012, which claims priority from German applications No.: 10 2011 076 672.3 filed on May 30, 2011.

TECHNICAL FIELD

Various embodiments relate to a signaling device including a first signaling illuminant, a second signaling illuminant, and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state. The disclosure furthermore relates to a sensor device for operating a lighting device comprising a signaling device of this type.

BACKGROUND

A signaling device of this type is known from the prior art. In this case, the control device has a first output, to which the first signaling illuminant is coupled, and a second output, to which the second signaling illuminant is coupled, such that the two signaling illuminants are operated in parallel.

By way of example, a motion sensor for detecting motion, a phototransistor for detecting an ambient brightness and/or an IR (infrared) signal receiving device can be coupled to the information input. Sensor devices constitute the combination of a signaling device of this type and so-called sensor auxiliary devices and/or an IR signal receiving device, said sensor devices being used for example in lighting control systems with a plurality of distributed measurement locations. A plurality of such sensor devices are then preferably coupled to a superordinate central control device, wherein said superordinate central control device comprises a power supply unit, which also supplies the connected sensor devices. Instead of an IR signal receiving device, it is also possible to use other devices for feeding information into the signaling device, for example a DALT transmitting device. Generally, the information fed in can be used for the configuration of the lighting control system, for example the brightness value starting from which lighting devices are intended to be switched on or how long after motion has been detected a lighting device is intended to remain in the switched-on state.

The respective signaling device of the corresponding sensor device is used to give the user optical feedback, that is to say whether or not the configuration process was completed successfully. In this respect, a sensor device of this type need not comprise a dedicated IR transmitting device or a DALI transmitting device.

The known manner of operation of the two signaling illuminants results in an undesirably high energy consumption. This disadvantage becomes particularly significant if it is recalled that up to four sensor devices of this type are used at a superordinate central control device for a lighting system.

DE 101 03 611 A1 discloses a circuit arrangement for operating a plurality of illuminants. In this case, for their power supply all the illuminants are connected to a power source in a series. In order to switch off an illuminant, the latter is short-circuited by means of a bridging element. The illuminants presented therein serve for lighting rather than signaling. Moreover, the implementation is extremely complex since potential-free switching of each illuminant has to be ensured by complex measures.

SUMMARY

Various embodiments provide a signaling device mentioned in the introduction in such a way that a reduction of the energy consumption is made possible. Various embodiments furthermore provide a sensor device for operating a lighting device.

The present disclosure is based on the insight that, in the known signaling device, in one exemplary embodiment, in the third state, each signaling illuminant consumes 5 mA and the control device likewise 5 mA of current, that is to say overall a total current consumption of 15 mA. The cause of this is that the signaling illuminants are operated in parallel. If the two signaling illuminants are then operated in a series circuit in the third state, the control device in the embodiment has to provide only 10 mA, that is to say 5 mA for the two signaling illuminants and 5 mA for the control device itself. A significant energy saving can be achieved by this procedure, with minimal additional outlay on components.

A first embodiment is distinguished by a discrete construction. In this case, the control device comprises a bridge circuit having a first, a second, a third and a fourth electronic switch, wherein the first electronic switch and the second electronic switch are coupled in a parallel circuit between a supply voltage and the bridge center point, wherein the third electronic switch and the fourth electronic switch are coupled in a parallel circuit between the bridge center point and a reference potential, wherein the first signaling illuminant is coupled in series with the second electronic switch, wherein the second signaling illuminant is coupled in series with the third electronic switch, wherein a drive device is provided, which is configured to realize the following switching states of the electronic switches: a) first switch off; second switch off; third switch off; fourth switch on; b) first switch on; second switch off; third switch on; fourth switch off; c) first switch off; second switch on; third switch on; fourth switch off; and d) first switch on; second switch off; third switch off; fourth switch on. Accordingly, the first and second signaling illuminants are operated in a series circuit in the switching state c).

In an alternative embodiment, the control device includes a first, a second and a third terminal, wherein the first terminal is assigned to the first signaling illuminant, wherein the second terminal is assigned to the second signaling illuminant, wherein the third terminal is assigned to the first signaling illuminant and to the second signaling illuminant. In this case, the control device is preferably realized as a microcontroller or ASIC. In this case, the control device is furthermore preferably configured, for the purpose of setting the first, the second, the third and the fourth state, to correspondingly switch the potential at the first terminal, at the second terminal and at the third terminal. In this case, a selection is made preferably from the switching states "High", "Low" and "Open". Preferably, the terminals constitute digital I/O pins. Microcontrollers in the medium performance class generally have enough I/O terminals, such that only software outlay has to be taken into account in order to realize the present disclosure on the basis of a generic signaling device.

In one preferred embodiment, the first signaling illuminant is coupled to the first terminal of the control device, the second signaling illuminant is coupled to the second terminal of the control device, wherein the first signaling illuminant is coupled to the second signaling illuminant with the formation of a coupling point in such a way that there can be a flow in series through the first signaling illuminant and the second signaling illuminant from the first terminal to the second terminal, or vice versa, wherein the coupling point is coupled to the third terminal of the control device via a matching device. This constitutes a very simple realization of the present disclosure.

Preferably, the matching device includes at least one ohmic resistor. Particularly preferably, however, the matching device includes the series circuit formed by a first ohmic resistor and a first diode, in particular Schottky diode, and the series circuit formed by a second ohmic resistor and a second diode, in particular Schottky diode, which is reverse-connected in parallel with the series circuit formed by the first ohmic resistor and the first diode. This realization takes account of the fact that different signaling illuminants are to be operated with different voltages in order to ensure optimum driving. If LEDs are used for the signaling illuminants, for example, then the preferred resistance value for an LED which emits in the red wavelength range is different than that for an LED which emits in the green or blue wavelength range. These boundary conditions can be optimally taken into account by means of the preferred embodiment just presented. Accordingly, it is preferred if the first ohmic resistor has a different resistance value than the second ohmic resistor.

As a result, the center point potential is configured to be asymmetric, which improves operation in particular if one of the signaling illuminants constitutes a blue LED.

In one particularly preferred embodiment, the signaling device a terminal for coupling to a DC voltage source, wherein the signaling device furthermore includes a voltage regulator, the input of which is coupled to the terminal for coupling to a DC voltage source, wherein the voltage regulator is configured to provide at its output a voltage that is lower than the voltage present at its input. This opens up the possibility of firstly making available for at least one of the signaling illuminants the higher voltage present at the terminal for coupling to a DC voltage source, while the voltage at the output of the voltage regulator is made available to a correspondingly configured control device. This is because the lower the voltage for which the control device is configured, the lower the losses with which said control device can be operated. This configuration furthermore takes account of the fact that a series circuit formed by two signaling illuminants, in particular LEDs, is no longer possible below a specific voltage value, whereas control devices are commercially available, however, which can still operate at such a low voltage level. In terms of concrete numerical values, by way of example, a DC voltage source having a voltage of 5 V to 6 V can be connected to the terminal for coupling to a DC voltage source, while the voltage at the output of the voltage regulator, this voltage being used for supplying the control device, can be for example 3.3 V or even lower still.

One embodiment which makes use of this advantageous design includes an electronic switch having a control electrode, an operating electrode and a reference electrode, wherein the control device is coupled to the output of the voltage regulator, wherein the first signaling illuminant is coupled between the terminal for coupling to a DC voltage source and the operating electrode of the electronic switch, wherein the first of the three terminals of the control device is coupled to the control electrode of the electronic switch, wherein the second signaling illuminant is coupled between the second of the three terminals of the control device and the reference electrode of the electronic switch, wherein the reference electrode of the electronic switch is coupled to the third of the three terminals of the control device via the matching circuit.

In a further particularly preferred embodiment of the present disclosure, the control device includes a microcontroller and a driver device, wherein the microcontroller is coupled to the driver device via a first control line and a second control line, wherein the driver device has the first, the second and the third terminal. In this case, the microcontroller is preferably configured to apply switching signals for switching on the first or the second or the first and the second signaling illuminant to the driver device via the first control line and the second control line.

This configuration now opens up the possibility of coupling the microcontroller to the output of the voltage regulator, and coupling the driver device to the terminal for coupling to a DC voltage source. By nature of the fact that the microcontroller is operated with a low supply voltage in this way, firstly a power saving can be achieved, and secondly a voltage high enough for operating the two signaling illuminants in series in the third state is available via the driver device.

Generally, the first signaling illuminant is configured to emit a radiation in a first visible wavelength range, and the second signaling illuminant is configured to emit a radiation in a second visible wavelength range, which differs from the first visible wavelength range. The wavelength ranges can be, in particular, the red, green and blue wavelength ranges.

As already mentioned, the first signaling illuminant and the second signaling illuminant in each case constitute at least one LED. In this context, it can be provided that a first ohmic resistor is coupled in series with the first signaling illuminant and a second ohmic resistor is coupled in series with the second signaling illuminant.

As likewise already mentioned, the control device preferably has at least one output for driving a superordinate central control device in a manner dependent on the signal at the at least one information input.

Further advantageous embodiments are evident from the dependent claims. The preferred embodiments presented with regard to the signaling device according to the disclosure and their advantages correspondingly hold true, if applicable, to the sensor device according to the disclosure.

BRIEF DESCRIPTION OF THE DRAWING(S)

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which:

FIG. 1 shows a first embodiment of a signaling device according to the disclosure;

FIG. 2 shows an overview with different switching states of the terminals PB0, PB1, PB2 of the signaling device from FIG. 1 and the resultant switch-on and -off states of the LED1 and LED2;

FIG. 3 shows a schematic illustration of a second embodiment of a signaling device according to the disclosure;

DETAILED DESCRIPTION

Figure 4:
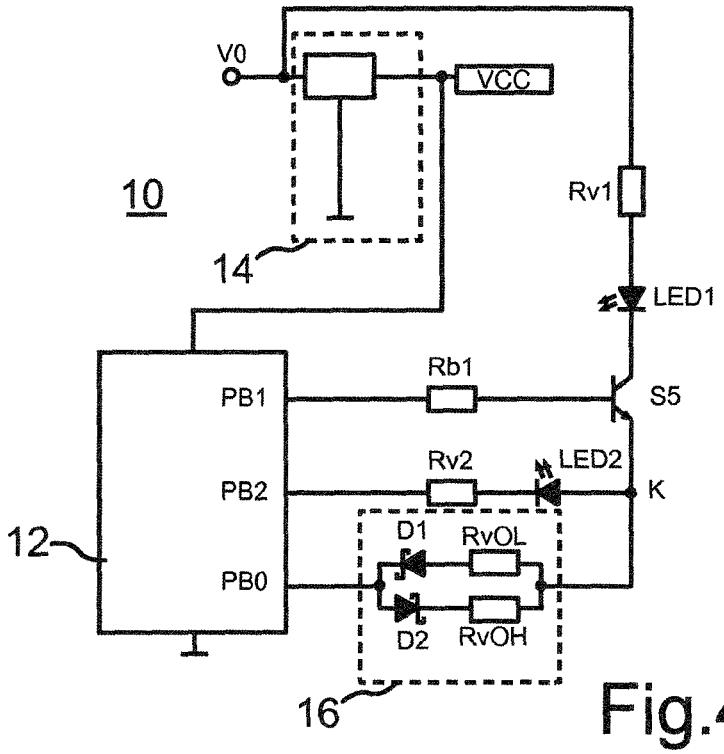
FIG. 4 shows a schematic illustration of a third embodiment of a signaling device according to the disclosure.

In the explanations below, the same reference signs are used for identical and identically acting components. These reference signs are only introduced once for the sake of clarity.

FIG. 1 shows a schematic illustration of a first embodiment of a signaling device 10 according to the disclosure. Said signaling device includes an LED1 and an LED2. An ohmic resistor Rv1 is coupled in series with the LED1, and an ohmic resistor Rv2 is coupled in series with the LED2. The LED1 and LED2 may also be realized by respective LED arrays each having a plurality of LEDs. While the LED1 emits radiation in a first wavelength range, the LED2 emits radiation in a second wavelength range, which differs from the first wavelength range. The LED1 may emit green light, for example, while the LED2 emits red light. The signaling device 10 includes a control device 12, which has at least one information input E for coupling to an information source. The control device 12 has three terminals PB0, PB1 and PB2, wherein the series circuit formed by the ohmic resistor Rv1 and the LED1 is coupled to the terminal PB1, the series circuit formed by the ohmic resistor Rv2 and the LED2 is coupled to the terminal PB2, and the coupling point K, via which the series circuit formed by LED1 and ohmic resistor Rv1 is coupled to the series circuit formed by the LED2 and the ohmic resistor Rv2, is coupled to the terminal PB0 via an ohmic resistor Rv0. The control device is preferably embodied as a microcontroller, wherein the control device 12 is configured to vary the potential at the terminals PB0, PB1, PB2, in particular between the potentials "Low", "High" and "Open". A sensor auxiliary unit, for example a motion detector, a brightness sensor, a DALI signal source or an IR signal receiving device, is preferably coupled to the information input E of the control device. In one preferred embodiment, the ohmic resistors Rv1, Rv2 each have a value of 300 and the ohmic resistor Rv0 has a value of 500Ω.

FIG. 2 shows in tabular form an overview of various potentials switched at the terminals PB0, PB1 and PB2 of the control device 12, and the associated operating states of the LED1 and LED2. For the state "LED1=On", accordingly, the terminal PB0 is to be set to "Low", the terminal PB1 to "High" and the terminal PB2 to "Open". As a result, the current flows from the terminal PB1 via the ohmic resistor Rv1, the LED1, the ohmic resistor Rv2 to the terminal PB0. For sole operation of the LED2, the terminal PB0 is to be set to "High", the terminal PB1 to "Open" and the terminal. PB2 to "Low". A current accordingly flows from the terminal PB0 via the ohmic resistor Rv0, the LED2 and the ohmic resistor Rv2 back to the terminal PB2. For the simultaneous operation of both LEDs, the terminal. PB0 is to be set to "Open", the terminal PB1 to "High" and the terminal PB2 to "Low". A current accordingly flows from the terminal PB1 via the ohmic resistor Rv1, the LED1, the LED2 via the ohmic resistor Rv2 back to the terminal PB2. Switching states of the terminals PB0, PB1 and PB2 in order to realize a state in which both LEDs are switched off can likewise be gathered from the table in FIG. 2. This state can be attained by means of a multiplicity of switching states.

FIG. 3 shows an embodiment of a signaling device 10 according to the disclosure realized by a discrete construction. Accordingly, the control device 10 includes a bridge circuit having a first S1, a second S2, a third S3 and a fourth electronic switch S4. The first electronic switch S1 and the second electronic switch S2 are coupled in a parallel circuit between a supply voltage V0 and the bridge center point BP. The third electronic switch S3 and the fourth electronic switch S4 are coupled in a parallel circuit between the bridge center point BP and the ground potential. The LED1 is coupled in series with the switch S2, while the LED2 is coupled in series with the switch S3. A respective ohmic resistor is again connected upstream of the respective LED. A drive device comprising the sub-drive devices V1, V2, V3, V4 serves for driving the respective switches. The drive device is configured, in particular, to realize the following states of the electronic switches S1 to S4:

a) switch S1 off; switch S2 on; switch S3 off; switch S4 on. As a result, only the LED1 is switched on.
b) switch S1 on; switch S2 off; switch S3 on; switch S4 off. As a result, only the LED2 is switched on.
c) switch Si off; switch S2 on; switch S3 on; switch S4 off. As a result, both the LED1 and the LED2 are switched on.
d) switch S1 on; switch S2 off; switch S3 off; switch S4 on. In this state, both LEDs are switched off.

FIG. 4 shows a further embodiment of a signaling device 10 according to the disclosure. Said signaling device includes a voltage regulator 14, the input of which is coupled to a terminal for coupling to a DC voltage source V0. At its output, the voltage regulator 14 provides a voltage VCC that is lower than the voltage V0 at its input. The voltage V0 can be 5 V, for example, and the voltage VCC can be 3.3 V or even lower still. While the series circuit formed by ohmic resistor Rv2 and LED2 is coupled, as in FIG. 1, to the terminal PB2 of the control device 12, the LED1 is coupled via its series resistor Rv1 to the terminal for coupling to the DC voltage source V0.

A switch S5 is coupled in series with the LED1, the base of said switch being coupled to the terminal PB1 of the control device 12 via a base resistor Rb1. The operating electrode of the switch S5 is coupled to the series circuit formed by the LED1 and the ohmic resistor Rv1. The reference electrode of the switch S5 is coupled to the coupling point K, wherein a matching device 16 is coupled between the coupling point K and the terminal PB0 of the control device 12, which includes the series circuit formed by an ohmic resistor Rv0L and a first Schottky diode D1, and the series circuit formed by a second ohmic resistor Rv0H and a second Schottky diode D2, which is reverse-connected in parallel with the series circuit formed by the first ohmic resistor Rv0L and the first Schottky diode D1. This measure takes account of the fact that, in order to be able to switch the transistor S5, the voltage VCC must be higher than the voltage at the coupling point K at least by the base-emitter voltage. Such a design of the matching device 16 enables the available residual voltage to be optimally utilized, wherein the resistance values Rv0L and Rv0H must not become too low, since otherwise tolerances would have an increased effect. This measure makes it possible to take account of, in particular, the different forward voltages of different LEDs, in particular LEDs which differ with regard to the wavelength range of the light emitted by them.

During sole operation of the LED1, a current accordingly flows from V0 through Rv1, LED1, S5, Rv0L, D1 to the terminal PB0, while during sole operation of the LED2 a current flows from PB0 via D2, the ohmic resistor Rv0H, the LED2 and the ohmic resistor Rv2 back to the terminal PB2. If both LEDs are operated simultaneously, a current flows from V0 via Rv1, the LED1, the switch S5, the LED2, the ohmic resistor Rv2 to the terminal PB2 of the control device 12.

Figure 5:
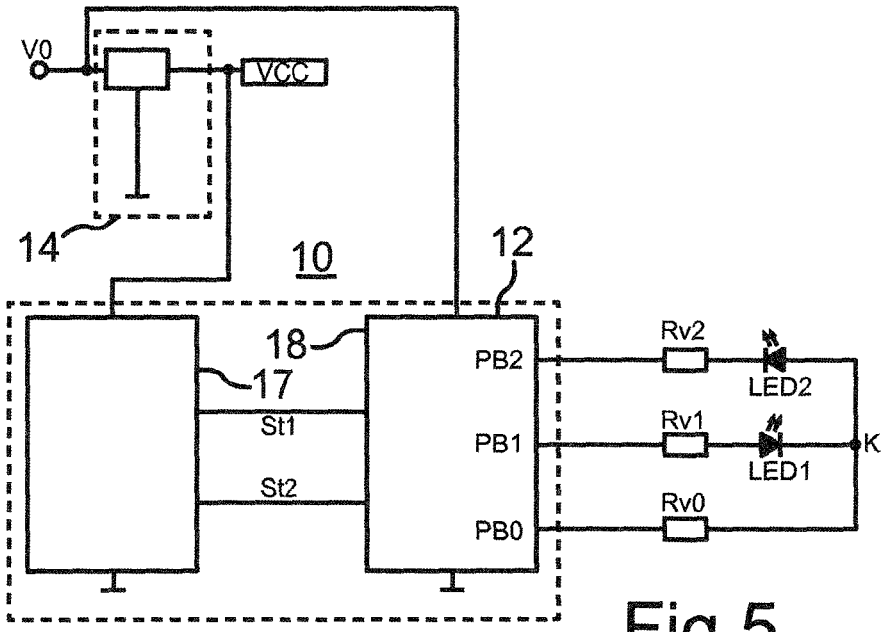
FIG. 5 shows a schematic illustration of a fourth embodiment of a signaling device according to the disclosure.

FIG. 5 shows an embodiment of a signaling device 10 according to the disclosure in which the control device includes a microcontroller 17 and a driver device 18, wherein the microcontroller 17 is coupled to the driver device 18 via a first control line St1 and a second control line St2. In this case, the driver device 18 has the terminals PB0, PB1, PB2. Via the control lines St1, St2, the microcontroller 17 may apply switching signals for switching on the LED1 or the LED2 or the LED1 and the LED2 or for switching off both LEDs to the driver device 18. The driver device 18 may constitute a tristate driver component, in particular, which converts two switching signals of the microcontroller 17 into three drive signals for the LED pair.

In this embodiment, the microcontroller 17 can be operated with the low supply voltage VCC, which results in a power saving. For the series circuit formed by the two LEDs in the operating state in which both LEDs are to be switched on, by means of the coupling of the driver component 18 to the terminal for a DC voltage source V0, enough voltage is available, such that, in particular, even blue LEDs can be operated in such an arrangement.

Figure 6:
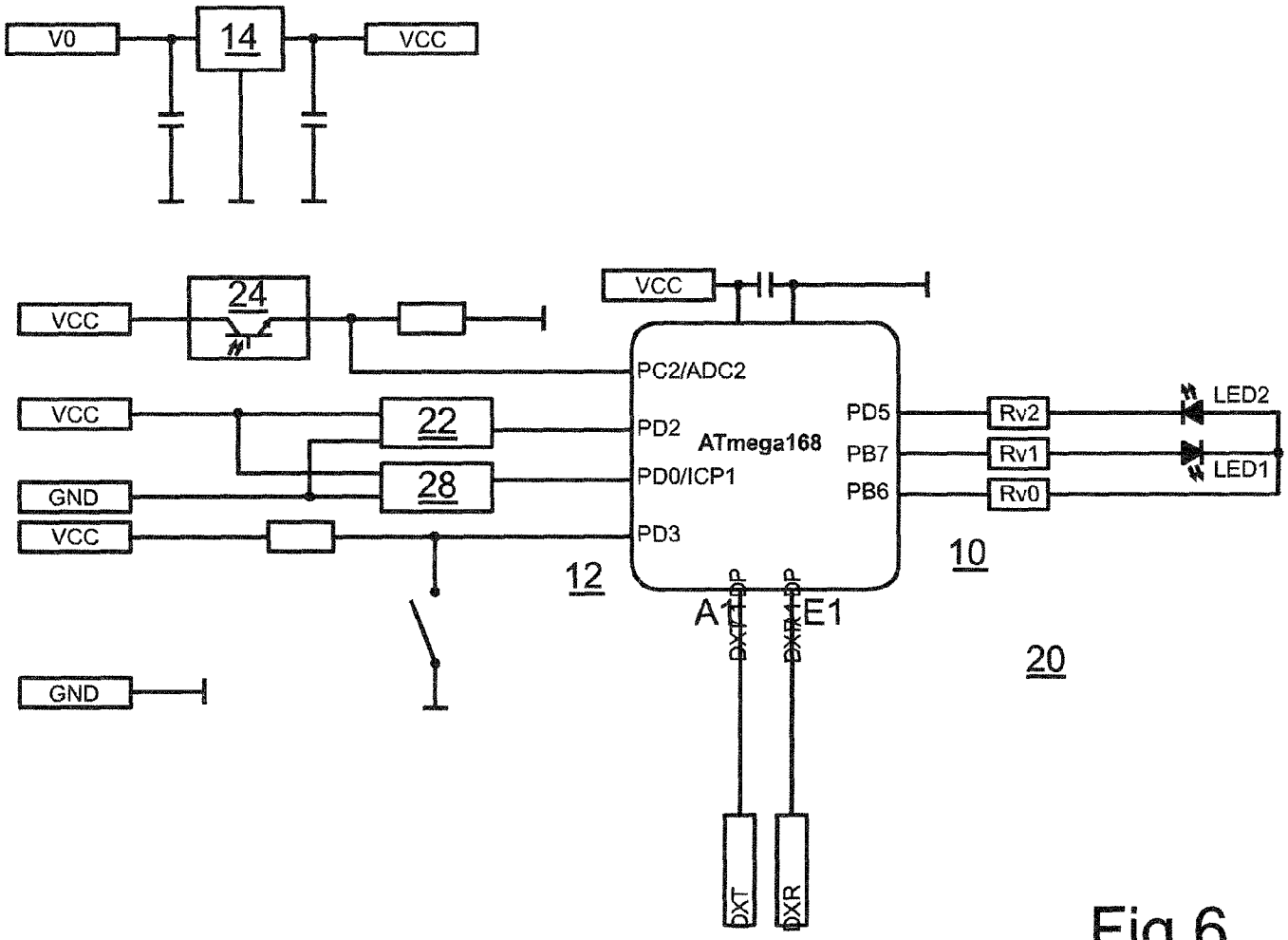
FIG. 6 shows an embodiment of a sensor device according to the disclosure.

FIG. 6 shows an embodiment of a sensor device 20 according to the disclosure for operating a lighting device which comprises one of the signaling devices already presented. In the embodiment illustrated in FIG. 6, an ATmega168 component is used as the control device. The terminal designations of this component have been adopted in the illustration. In this case, the terminal PB6 corresponds to the terminal PB0 in the other embodiments, the terminal PB7 corresponds to the terminal PB1, and the terminal PD5 corresponds to the terminal PB2. In this embodiment, some sensor auxiliary devices, in particular a motion detector 22 and a brightness sensor 24, are connected to the control device 12. An IR signal receiving device 28 is coupled to a further information input, and is configured to provide an information signal correlated with the received IR signal to the corresponding information input of the control device 12. Moreover, the control device 12 has an output A1 and at least one input E1 in order to communicate with a superordinate central control device (not illustrated), which can be coupled to a plurality of such sensor devices 20. Via the IR signal receiving device 28, in particular signals are fed into the control device 12 in order to configure a lighting device coupled to the superordinate central control device.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A signaling device comprising a first signaling illuminant;

a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state, wherein the control device comprises a bridge circuit having a first, a second, a third and a fourth electronic switch, wherein the first electronic switch and the second electronic switch are coupled in a parallel circuit between a supply voltage and the bridge center point, wherein the third electronic switch and the fourth electronic switch are coupled in a parallel circuit between the bridge center point and a reference potential, wherein the first signaling illuminant is coupled in series with the second electronic switch, wherein the second signaling illuminant is coupled in series with the third electronic switch, wherein a drive device is provided, which is configured to realize the following switching states of the electronic switches:

a) first switch off; second switch on; third switch off; fourth switch on;

b) first switch on; second switch off; third switch on; fourth switch off;

c) first switch off; second switch on; third switch on; fourth switch off; and d) first switch on; second switch off; third switch off; fourth switch on.

2. A signaling device comprising a first signaling illuminant;

a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state, wherein the control device comprises a first, a second and a third terminal, wherein the first terminal is assigned to the first signaling illuminant, wherein the second terminal is assigned to the second signaling illuminant, wherein the third terminal is assigned to the first signaling illuminant and to the second signaling illuminant, wherein the first signaling illuminant is coupled to the first terminal of the control device, the second signaling illuminant is coupled to the second terminal of the control device, wherein the first signaling illuminant is coupled to the second signaling illuminant with the formation of a coupling point in such a way that there can be a flow in series through the first signaling illuminant and the second signaling illuminant from the first terminal to the second terminal, or vice versa, wherein the coupling point is coupled to the third terminal of the control device via a matching device.

3. The signaling device as claimed in claim 2, wherein the matching device comprises at least one ohmic resistor.

4. The signaling device as claimed in claim 3, wherein the matching device comprises:

the series circuit formed by a first ohmic resistor and a first diode; and the series circuit formed by a second ohmic resistor and a second diode, which is reverse-connected in parallel with the series circuit formed by the first ohmic resistor and the first diode.

5. The signaling device as claimed in claim 4, wherein the first ohmic resistor has a different resistance value than the second ohmic resistor.

6. The signaling device as claimed in claim 2, wherein the signaling device comprises a terminal for coupling to a DC voltage source, wherein the signaling device furthermore comprises a voltage regulator, the input of which is coupled to the terminal for coupling to a DC voltage source, wherein the voltage regulator is configured to provide at its output a voltage that is lower than the voltage present at its input.

7. The signaling device as claimed in claim 6, wherein the signaling device comprises an electronic switch having a control electrode, an operating electrode and a reference electrode, wherein the control device is coupled to the output of the voltage regulator, wherein the first signaling illuminant is coupled between the terminal for coupling to a DC voltage source and the operating electrode of the electronic switch, wherein the first of the three terminals of the control device is coupled to the control electrode of the electronic switch, wherein the second signaling illuminant is coupled between the second of the three terminals of the control device and the reference electrode of the electronic switch, wherein the reference electrode of the electronic switch is coupled to the third of the three terminals of the control device via a matching circuit.

8. A signaling device comprising a first signaling illuminant;

a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state, wherein the control device comprises a first, a second and a third terminal, wherein the first terminal is assigned to the first signaling illuminant, wherein the second terminal is assigned to the second signaling illuminant, wherein the third terminal is assigned to the first signaling illuminant and to the second signaling illuminant, wherein the control device comprises a microcontroller and a driver device, wherein the microcontroller is coupled to the driver device via a first control line and a second control line, wherein the driver device has the first, the second and the third terminal.

9. The signaling device as claimed in claim 8, wherein the microcontroller is configured to apply switching signals for switching on the first or the second or the first and the second signaling illuminant to the driver device via the first control line and the second control line.

10. The signaling device has claimed in claim 8, wherein the microcontroller is coupled to the output of a voltage regulator and the driver device is coupled to the terminal for coupling to a DC voltage source.

11. The signaling device as claimed claim 8, wherein the first signaling illuminant is configured to emit a radiation in a first visible wavelength range; and wherein the second signaling illuminant is configured to emit a radiation in a second visible wavelength range, which differs from the first visible wavelength range.

12. The signaling device as claimed in claim 8, wherein the first signaling illuminant and the second signaling illuminant in each case comprise at least one LED.

13. The signaling device as claimed in claim 12, wherein a first ohmic resistor is coupled in series with the first signaling illuminant and a second ohmic resistor is coupled in series with the second signaling illuminant.

14. A signaling device comprising a first signaling illuminant;

a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state, wherein the control device has at least one output for driving a superordinate central control device in a manner dependent on the signal at the at least one information input.

15. A sensor device for operating a lighting device comprising a signaling device, the signaling device comprising:

a first signaling illuminant;

a second signaling illuminant; and a control device having at least one information input for coupling to an information source, wherein the control device is configured to drive the first signaling illuminant and the second signaling illuminant in a manner dependent on the signal at the information input in order to set one of four states, wherein only the first signaling illuminant is switched on in the first state, only the second signaling illuminant is switched on in the second state, the first signaling illuminant and the second signaling illuminant are switched on in the third state, wherein the first signaling illuminant and the second signaling illuminant are switched off in the fourth state, wherein the control device is configured to operate the first signaling illuminant and the second signaling illuminant in a series circuit in the third state, wherein the control device has at least a first and a second information input, wherein the sensor device furthermore comprises:

a first sensor auxiliary device, which is coupled to the first information input of the control device, wherein the first sensor auxiliary device is configured to measure at least one lighting-relevant parameter and to provide a signal correlated therewith at the first information input of the control device; and an IR signal receiving device, which is coupled to the second information input of the control device, wherein the IR signal receiving device is configured to provide an information signal correlated with the received IR signal at the second information input of the control device.

* * * * *

UNITED STATES PATENT AND TRADEMARK OFFICE

CERTIFICATE OF CORRECTION

PATENT NO. : 9,224,317 B2
APPLICATION NO. : 14/123114
DATED : December 29, 2015
INVENTOR(S) : Joerg Lott It is certified that error appears in the above-identified patent and that said Letters Patent is hereby corrected as shown below:

In the Specification:

Column 1, line 51: Please delete "DALT" between the words "a" and "transmitting", and write "DALI" in place thereof.

Column 5, line 33: Please write a number "12" between the words "device" and "is".

Column 5, line 41: Please delete the number "300" between the words "of" and "and", and write "300Ω" in place thereof.

Column 5, line 56: Please delete the "." between the word "terminal" and "PB0".

Column 6, line 19: Please delete "Si" between the words "switch" and "off", and write "S1" in place thereof.

Signed and Sealed this
Twenty-third Day of August, 2016

Michelle K. Lee

Michelle K. Lee
*Director of the United States Patent and Trademark Office*